US006191690B1

(12) United States Patent
Mukogawa

(10) Patent No.: US 6,191,690 B1
(45) Date of Patent: Feb. 20, 2001

(54) CASH CASSETTE BURGLARY PREVENTION SYSTEM AND CASH CASSETTE BURGLARY PREVENTION METHOD

(75) Inventor: Satoshi Mukogawa, Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 09/539,612

(22) Filed: Mar. 31, 2000

(30) Foreign Application Priority Data

Jul. 15, 1999 (JP) ..... 11-201361

(51) Int. Cl.[7] ..... G08B 13/14

(52) U.S. Cl. ..... 340/568.7; 340/686.6; 340/687

(58) Field of Search ..... 340/686.6, 686.1, 340/687, 570, 560.1, 531, 539, 568.7

(56) References Cited

U.S. PATENT DOCUMENTS

| | | | | |
|---|---|---|---|---|
| 5,053,748 | * | 10/1991 | Stern | 340/541 |
| 5,410,295 | * | 4/1995 | Van Lint | 340/568 |
| 5,530,426 | * | 6/1996 | Wilk | 340/531 |
| 5,583,486 | * | 12/1996 | Kersten | 340/568 |
| 5,952,920 | * | 9/1999 | Braddick | 340/568.1 |

FOREIGN PATENT DOCUMENTS

| | | |
|---|---|---|
| 8-66221 | 3/1996 | (JP) . |
| 8-86149 | 4/1996 | (JP) . |
| 8-339482 | 12/1996 | (JP) . |
| 10-55490 | 2/1998 | (JP) . |

* cited by examiner

*Primary Examiner*—Jeffery A. Hofsass
*Assistant Examiner*—Daniel Prévil
(74) *Attorney, Agent, or Firm*—Armstrong, Westerman, Hattori, McLeland & Naughton

(57) ABSTRACT

The distance between a cash cassette and the person who is handling the cassette is measured automatically in case that there is a risk that a cash cassette may be stolen during a burglary. When the distance equals or exceeds a predetermined distance, it is concluded that a burglary has occurred, and various burglary alarm devices are activated. Accordingly, even when only one person performs a cash cassette exchange at a location which is easily accessible to other people, the commission of a crime can be immediately detected, so that the theft of a cash cassette during a burglary can be prevented. Therefore, the number of persons required for a cash cassette exchange can be reduced, which results to a reduction of operating costs. Further, since extra space is not required for a cash cassette exchange, restriction of a choice of an installation location for an automatic transaction apparatus can be considerably reduced.

8 Claims, 2 Drawing Sheets

CASH CASSETTE BURGLARY PREVENTION SYSTEM AND CASH CASSETTE BURGLARY PREVENTION METHOD

BACKGROUND OF THE INVENTION

1. Field of the Invention

The present invention relates to a burglary prevention system for protecting and preventing the theft of cash cassettes loaded in automatic transaction apparatuses, such as automated-teller machines (ATMs), which can be used for a variety of transactions.

2. Related Arts

An automatic transaction apparatus, such as an automated-teller machine (ATM), which can be used for a variety of transactions incorporates a cash cassette in which is stored money required for an accounting process performed for cash transactions. The cash cassette is exchanged periodically, or when the supply of money remaining in it becomes low.

Burglaries during which cash cassettes are stolen tend to occur when cassettes are being exchanged. Burglaries may also occur after the door of an automatic transaction apparatus has been opened for the performance of maintenance procedures. In order to prevent such crimes, conventionally, a lockable room is provided adjacently behind the automatic transaction apparatus, and in that room, an operator responsible for the machine can exchange cash cassettes or a maintenance man can service the machine. If no work space is defined behind the automatic transaction apparatus, however, the number of operators or maintenance men who handle cash cassettes is increased to prevent burglaries.

Recently, the tendency is to install automatic transaction apparatuses in restricted spaces. Specifically, in addition to being installed in financial facilities, an increasing number of automatic transaction apparatuses are being installed in stores, such as convenience stores, for which the apparatuses provide not only a cash withdrawal function but are also employed to sell tickets to various events and to function as computer game software vending machines.

In small shops, such as convenience stores, it is difficult to obtain the space necessary for a locked room behind an automatic transaction apparatus. Further, since the customers of a convenience store usually patronize the store at all hours, day and night, when an operator who is responsible for a machine must exchange cash cassettes under these conditions, there is always the danger that a criminal act, a burglary, may take place during which a cash cassette is stolen. In this case, as is described above, to preclude the commission of such a crime the number of responsible operators is increased.

However, an increase in the number of such operators is accompanied by a rise in operating costs. And since it is predicted that the installation of automatic transaction apparatuses in restricted spaces, as is described above, will increase, and that the additional operating costs involved will tend to preclude the implementation of a policy providing for an increase in the number of responsible operators, a corresponding rise is also anticipated in the number of burglaries during which cash cassettes are stolen.

SUMMARY OF THE INVENTION

It is, therefore, one objective of the present invention to provide a cash cassette burglary prevention system and a cash cassette burglary prevention method by which automatic transaction apparatus cash cassettes are protected from being stolen during burglaries committed while cassettes are being exchanged, and for which only a minimum number of operators is required to exchange cash cassettes or to perform apparatus maintenance.

To achieve the above objective, according to the present invention, in case of a situation exists wherein the security of a cash cassette is at risk because the possibility is high that a burglary could occur, automatically, the distance between the cash cassette and an operator who is handling the cassette is measured. And when the measured distance equals or exceeds a predetermined distance, it is concluded that a burglary has occurred, and various burglary alarm devices are activated.

With this arrangement, even when only one person is employed to exchange cash cassettes at a location which is easily accessible to other people, a crime involving a cash cassette can be detected immediately, and a burglary during which a cash cassette is stolen can be prevented or the possibility such a criminal act will take place can be reduced. Therefore, the number of operators required to exchange cash cassettes can be reduced, and this, in turn, will contribute to a reduction in operating costs. Furthermore, since to perform a cash cassette exchange no extra space is required, location restrictions governing the installation of automatic transaction apparatuses can be considerably reduced.

For example, according to the present invention, it is provided a burglary prevention system comprising:

- a detector for detecting load and unload of the cash cassette in a predetermined location in the automatic transaction apparatus;
- a determination device, which is activated in accordance with the results obtained by the detector, for determining the distance between the cash cassette and an operator who is handling said cash cassette; and
- a burglary alarm device, which is activated in accordance with the results obtained by the determination device, for executing a predetermined burglary alarm operation.

With the above arrangement, for example, wherein the determination device is activated in case that the detector detects the unload of the cash cassette in the predetermined location; and the burglary alarm device is activated in case that the detector determines that the distance to the operator equals or exceeds a predetermined distance.

Furthermore, to achieve the above objective, it is provided a cash cassette burglary prevention method comprising the steps of:

- detecting load and unload of the cash cassette in a predetermined location in the automatic transaction apparatus;
- determining the distance between the cash cassette and an operator who is handling the cash cassette in case that the unload of the cash cassette is detected at said detecting step; and
- performing a predetermined burglary alarm operation in case that it is determined at the determining step that said distance between said cash cassette and said operator equals or exceeds a predetermined distance.

DETAILED DESCRIPTION OF THE PREFERRED EMBODIMENT

The preferred embodiment of the present invention will now be described. It should be noted, however, that the technical scope of the present invention is not limited to this embodiment.

Figure 1:
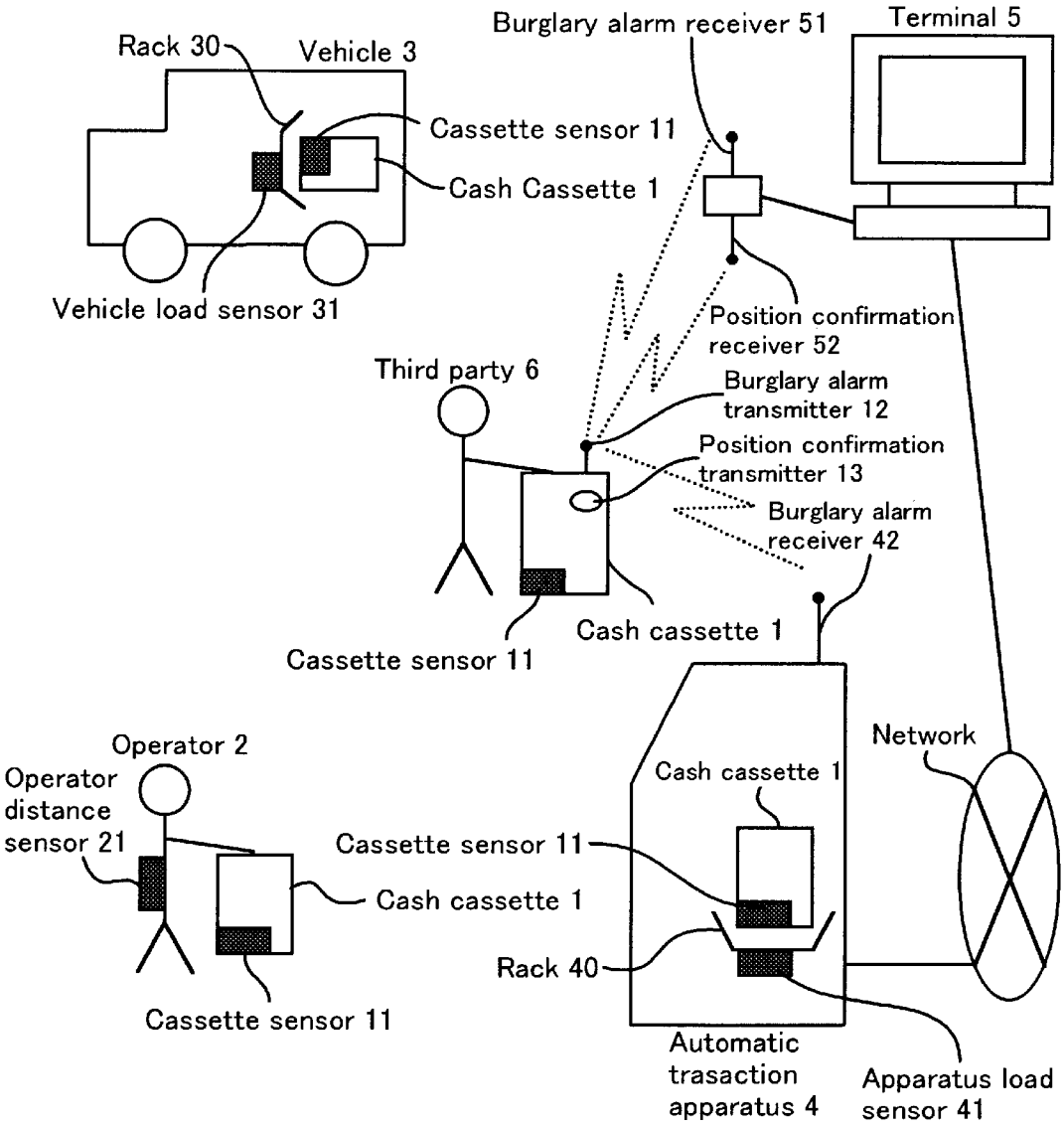
FIG. 1 is a diagram illustrating the arrangement of a cash cassette burglary prevention system according to one embodiment of the present invention.

FIG. 1 is a diagram illustrating the arrangement of a cash cassette burglary prevention system according to this embodiment of the present invention. In FIG. 1, an operator 2 for handling a cash cassette 1 attaches to the cash cassette 1 an operator distance sensor 21, which is a part of a distance measurement device. Included in the cash cassette 1 is a cassette sensor 11. As is shown in FIG. 2 which will be referred to later, the cassette sensor 11 includes a cassette distance sensor 111, which is a part of the distance measuring device, and a cassette load sensor 112, which is a part of a loading detection device for detecting whether the cash cassette 1 has been loaded into a predetermined rack.

A vehicle 3, which delivers the cash cassette 1, has a rack 30 in which the cash cassette 1 is stored, and a vehicle load sensor 31, which is a part of the loading detection device and which is attached to the rack 30. Internally provided in an automatic transaction apparatus 4 is a rack 40 into which the cash cassette 1 is placed, and attached to the rack 40 is an apparatus load sensor 41, which is a part of the loading detection device.

The automatic transaction apparatus 4 is connected via a network to a terminal 5 in a monitoring center. The terminal 5 at the monitoring center is connected to a burglary alarm receiver 51, for receiving an alarm from a burglary alarm transmitter 12 provided for the cash cassette 1, and to a position confirmation signal receiver 52, for receiving a position confirmation signal from a position confirmation signal transmitter 13 provided for the cash cassette 1.

Figure 2:
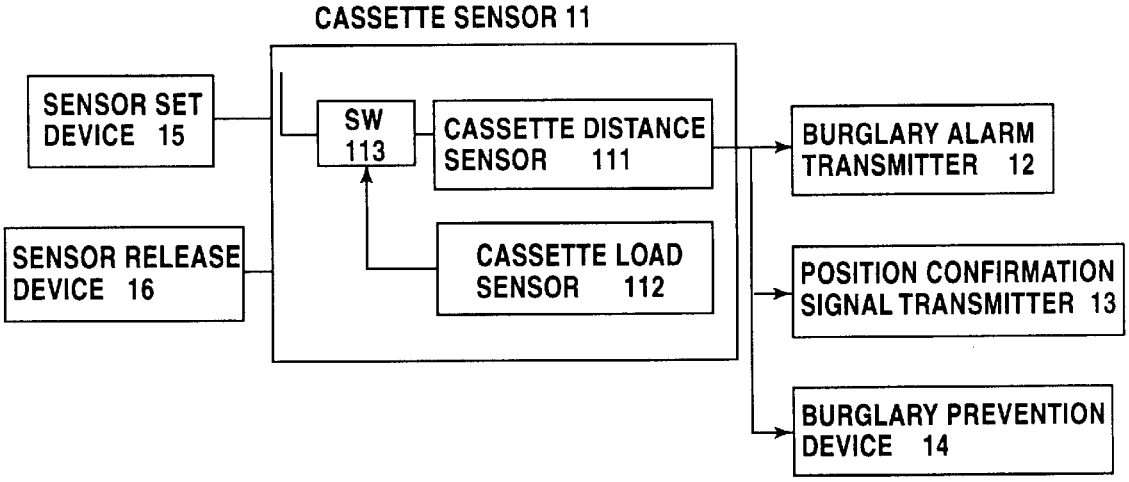
FIG. 2 is a block diagram illustrating a cassette sensor.

FIG. 2 is a block diagram illustrating the cassette sensor 11. The cassette sensor 11 includes the cassette distance sensor 111, the cassette load sensor 112 and a switch 113. The cassette distance sensor 111 measures the distance to the operator distance sensor 21. For example, the operator distance sensor 21 includes a transmitter for transmitting a weak radio wave, and the cassette distance sensor 111 includes a receiver for receiving the wave. In accordance with the level of the received wave, the cassette distance sensor 111 determines whether the distance between the cash cassette 1 and the operator 2 equals or exceeds a predetermined distance. Normally, the operator 2 is not separated from the cash cassette 1 during the operation in which the cash cassette 1 is unloaded from the rack 30 of the vehicle 3, is carried to the automatic transaction apparatus 4, and is loaded into the rack 40. Therefore, in a normal situation, the cassette distance sensor 111 receives a radio wave having a predetermined level or higher.

However, once the cash cassette 1 has been stolen by a third party 6, the cash cassette 1 will be moved away from the operator 2. And since the operator distance sensor 21 is not attached to the third party 6, the distance between the operator distance sensor 21 and the cassette sensor 11 will equal or exceed the predetermined distance, and the level of the wave received by the cassette distance sensor 111 will fall below the predetermined level.

When the reception level of the cassette distance sensor 111 falls below the predetermined level, the cassette distance sensor 111 concludes that the cash cassette 1 has been stolen, and activates a burglary prevention device 14, the burglary alarm transmitter 12 and the position confirmation signal transmitter 13, which together constitute a burglary alarm apparatus. The burglary prevention device 14 is, for example, an alarm generator, a smoke generator, a perfumed ink spray, a light emitting device, or a combination of these devices. The burglary alarm transmitter 12 generates a burglary alarm signal and notifies the monitoring center of the occurrence of a burglary. The burglary alarm signal may be received by the burglary alarm receiver 42 mounted in the automatic transaction apparatus 4, and may be transmitted therefrom via the network to the terminal 5 of the monitoring center. The position confirmation signal transmitter 13 obtains the current position information for the cash cassette 1 from a GPS system, which uses an artificial satellite, and transmits to the monitoring center a position confirmation signal, which includes that position information. When the burglary alarm receiver 51 receives a burglary alarm signal, an alarm message is displayed on the screen of the terminal 5 at the monitoring center. Further, when the position confirmation signal receiver 52 receives a position confirmation signal, the position information is displayed on the screen along with the alarm message.

With this arrangement, when a cash cassette 1 is stolen during a cash cassette exchange, the cassette distance sensor 111 mounted in the cash cassette 11 automatically detects the burglary; and the burglary prevention device 14, the burglary alarm transmitter 12 and the position confirmation signal transmitter 13 perform predetermined alarm operations. Thus, there is an immediate reaction to the theft of the cash cassette 1.

Both the cassette distance sensor 111 and the operator distance sensor 21 may include a transmitter/receiver, so that the cassette distance sensor 111 may transmit a radio wave at a predetermined level and the operator distance sensor 21 may receive the wave. In this case, when the reception level falls below the predetermined level, the operator distance sensor 21 transmits an abnormal event detection signal to the cassette distance sensor 111, and upon receiving the signal, the cassette distance sensor 111 activates the individual burglary alarm devices 12, 13 and 14. The cassette load sensor 112 in the cassette sensor 11 interacts with the vehicle load sensor 31, or the apparatus load sensor 41 and turns on or off the switch 113 so that the cassette distance sensor 111 is operated in the period during which the cash cassette 1 is neither in the rack 30 in the vehicle nor the rack 40 in the automatic transaction apparatus 4. When the switch 13 is in the ON state, the cassette distance sensor 111 is operated, and when it is in the OFF state, the cassette distance sensor 111 is not operated.

The load sensors 112, 31 and 41 are sensors for determining whether the cash cassette 1 is mounted in the rack 30 or the rack 40. The load sensor 112 is, for example, a conductor sensor. When the cassette 1 is correctly loaded in the rack 30 in the vehicle or in the rack 40 in the automatic transaction apparatus 4, the cassette load sensor 112 is brought into contact with either the vehicle load sensor 31 or the apparatus load sensor 41. The cassette load sensor 112 is then rendered conductive, and turns off the switch 113. When the cash cassette 1 is not loaded into either the rack 30 or the rack 40, the cassette load sensor 112 does not contact the vehicle load sensor 31 or the apparatus load sensor 41, and since then it is rendered non-conductive, it turns on the switch 113 and activates the cassette distance sensor The load sensors 112, 31 and 41 may be magnetic sensors. In this case, when the cassette load sensor 112 is positioned so it is close to the vehicle load sensor 31 or the apparatus load sensor 41, even though it does not contact either sensor 31 or 41, the loading of the cash cassette 1 into the rack 30 or the rack 40 can be detected.

As is described above, so long as the cash cassette 1 is loaded into the rack 30 or the rack 40, the cash cassette 1 is safe, regardless of its distance from the operator 2, and the cassette distance sensor 111 is not conductive. Since the cash cassette 1 is exposed and is in danger of being stolen during a burglary once it is unloaded from the rack 30 or the rack 40, the cassette distance sensor 111 is rendered conductive. But when the operator 2 is near the cash cassette 1 during the unloading and the exchanging of cash cassettes 1, the cassette distance sensor 111 receives a radio wave from the operator distance sensor 21 which exceeds the predetermined level and continuously determines normal event has occurred. Then, when the cash cassette 1 has been loaded into the rack 40 of the automatic transaction apparatus 4, the cassette distance sensor 111 is rendered non-conductive.

When cash cassettes 1 are exchanged, normally, an old cash cassette 1 is stored in the rack in the automatic transaction apparatus 4. In this case, when the operator 2 removes the old cash cassette 1 from the rack 40, the cassette distance sensor 111, which is mounted in the cassette sensor 11 of the old cash cassette 1, is changed from non-conductive to conductive. Then, the cassette distance sensor 111 examines the distance in the same manner as previously described until the old cash cassette 1 is loaded into the rack 30, whereupon the cassette distance sensor 111 is rendered non-conductive.

As is shown in FIG. 2, a sensor setting device 15 and a sensor release device 16 are connected to the cassette sensor 11. The sensor setting device 15 is a device for validating the overall operation of the cassette sensor 11. That is, that the cassette load sensor 112 has been rendered active and the cassette distance sensor 111 has been set to the enabled state. The sensor setting device 15 is constituted, for example, by a simple switch, so that validation of the cassette sensor 11 can be easily performed, simply by depressing the switch.

Assuming a case wherein, in a situation in which security is ensured, a person other than an operator 2 (a person to whom an operator distance sensor 21 is not attached) unloads a cash cassette 1 from the rack 30 or 40 and carries it away. In this case, if the cassette sensor 11 has been validated, the cassette distance sensor 111 is rendered active when the cash cassette 1 is unloaded from the rack 30 or 40, and the individual burglar alarm devices 12, 13 and 14 are activated, even though an actual burglary has not taken place. Therefore, the sensor release device 16 is required to invalidate the overall operation of the cassette sensor 11. Specifically, the sensor release device 16 forcibly renders the cassette distance sensor 111 and the cassette load sensor 112 nonconductive. Accordingly, the distance measuring device and the loading detection device, which are respectively constituted by the cassette distance sensor 111 and the cassette load sensor 112, are also rendered non-conductive. For security reasons, it is preferable that no one be permitted to operate the sensor release device 16 until it has been ascertained that current security information matches information which has been registered in advance. The examination of the security information is conducted by comparing, for example, a key, an ID number, a code number or a fingerprint. For this examination, the sensor release device 16 includes, for example, a key hole, an ID card reader in which an ID number is stored, numbered keys for entering a code number, or a finger print sensor for entering a fingerprint. Then, when the sensor release device 16 is activated, the cassette distance sensor 111 and the cassette load sensor 112 are rendered inactive.

Figure 3A:
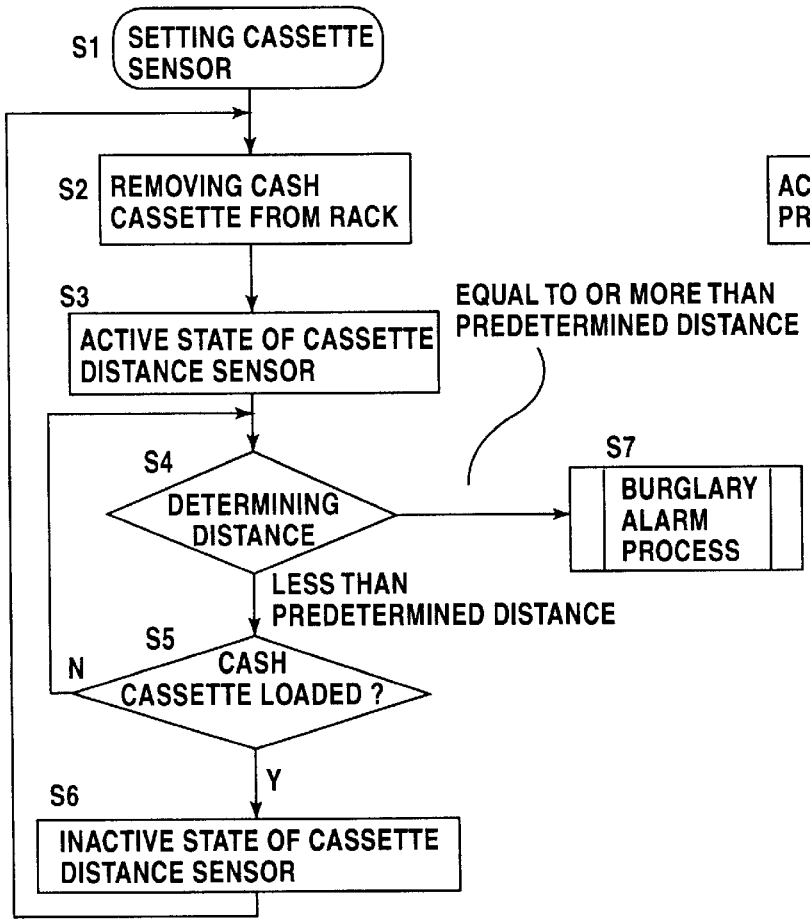
FIG. 3 is a flowchart showing the processing performed by the cash cassette burglary prevention system according to the embodiment of the present invention.
Figure 3B:
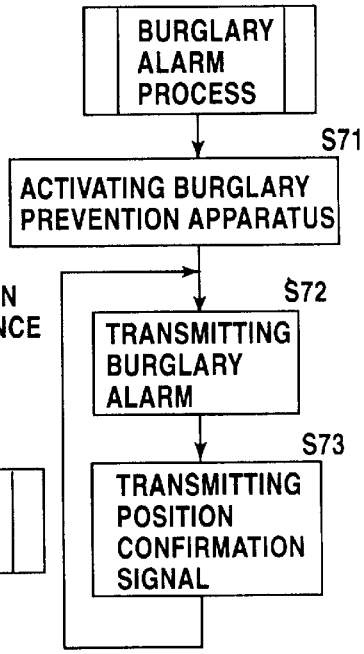

FIG. 3 is a flowchart showing the processing performed by the cash cassette burglary prevention system according to the embodiment of the present invention. At step S1 in FIG. 3, the sensor setting device is activated and validates the cassette sensor 11. At this time, the cash cassette 1 is loaded in the rack 30 or 40, and the cassette distance sensor 111 has not been activated. When, at step S2, the cash cassette 1 is removed from the rack 30 or 40, at step S3, the cassette distance sensor 111 is rendered active. At step S4, the cassette distance sensor 111 determines the level of a radio wave received from the operator distance sensor 21. If, at step S4, the reception level exceeds a predetermined level, the cassette distance sensor 111 continues to monitor the reception level. When, at step S5, the cash cassette 1 is again loaded into the rack 30 or 40, at step S6, the cassette distance sensor 111 is rendered inactive.

When, at step S4, the reception level falls below the predetermined level, at step S7, a predetermined burglary alarm process is initiated. In this process, at step S71 in FIG. 3, the burglary prevention device 14 is activated, and at step S72, the burglary alarm transmitter 12 transits a burglary alarm signal. Subsequently, at step S73, the position confirmation signal transmitter 13 transmits a position confirmation signal.

It should be noted that the above embodiment can be applied not only for an exchange of cash cassettes 1, but also when maintenance is being performed for an automatic transaction apparatus and a cash cassette 1 is unloaded from the rack 40.

As is described above, according to the present invention, even when only one person performs a cash cassette exchange at a location which is easily accessible to other people, the commission of a crime, such as a burglary during which a cash cassette is stolen, can be prevented or the possibility that one will occur can be reduced. Therefore, the number of persons required to exchange cash cassettes can be reduced, and this contributes to a reduction in operating costs. Furthermore, since extra space is not required for the exchange of cash cassettes, the restrictions applying to the choice of an installation location for an automatic transaction apparatus can be considerably reduced.

The scope of the coverage afforded by the present invention is not limited to the above embodiment, and also includes the invention and its equivalent as defined in the claims for the present invention.

What is claimed is:

1. A cash cassette burglary prevention system for preventing burglary of a cash cassette loaded in an automatic transaction apparatus, comprising:

a detector for detecting load and unload of said cash cassette in a predetermined location in said automatic transaction apparatus;

a determination device, which is activated in accordance with the results obtained by said detector, for determining the distance between said cash cassette and an operator who is handling said cash cassette; and a burglary alarm device, which is activated in accordance with the results obtained by said determination device, for executing a predetermined burglary alarm operation.

2. The cash cassette burglary prevention system according to claim 1, wherein said determination device is activated in case that said detector detects the unload of said cash cassette in said predetermined location; and said burglary alarm device is activated in case that said detector determines that said distance to said operator equals or exceeds a predetermined distance.

3. The cash cassette burglary prevention system according to claim 1, wherein said burglary alarm device is a tone generator, a smoke generator, an ink spray device, a light-emitting device, or a combination of said devices.

4. The cash cassette burglary prevention system according to claim 1, wherein said burglary alarm device is a burglary alarm transmission device for notifying the occurrence of a burglary to a monitoring center which monitors said automatic transaction apparatus.

5. The cash cassette burglary prevention system according to claim 1, wherein said burglary alarm device is a position information transmission device for notifying position information concerning said cash cassette to a monitoring center which monitors said automatic transaction apparatus.

6. The cash cassette burglary prevention system according to claim 1, wherein said predetermined location is a rack provided in said automatic transaction apparatus or in a vehicle which delivers said cash cassette; said detector includes a first portion to be attached to said cash cassette and a second portion to be attached to said rack; and said detector detects the load and unload of said cash cassette in said rack in accordance with contacting state or close state of said first portion and said second portion.

7. The cash cassette burglary prevention system according to claim 1, wherein said determination device includes a first portion to be attached to said operator and a second portion to be attached to said cash cassette, one of said first portion and said second portion transmits a radio wave having a predetermined level and the other portion receives said radio wave, and said determination device determines that the distance between said operator and said cash cassette equals or exceeds a predetermined distance in case that the level of said radio wave is equal to or lower than a predetermined level.

8. A cash cassette burglary prevention method for preventing burglary of a cash cassette loaded in an automatic transaction apparatus, comprising the steps of:

detecting load and unload of said cash cassette in a predetermined location in said automatic transaction apparatus;

determining the distance between said cash cassette and an operator who is handling said cash cassette in case that the unload of said cash cassette is detected at said detecting step; and performing a predetermined burglary alarm operation in case that it is determined at said determining step that said distance between said cash cassette and said operator equals or exceeds a predetermined distance.

* * * * *